US009909723B2

(12) United States Patent
Bergmann et al.

(10) Patent No.: US 9,909,723 B2
(45) Date of Patent: Mar. 6, 2018

(54) SMALL FORM-FACTOR LED LAMP WITH COLOR-CONTROLLED DIMMING

(71) Applicant: Cree, Inc., Durham, NC (US)

(72) Inventors: Michael John Bergmann, Raleigh, NC (US); Julio Garceran, Cary, NC (US)

(73) Assignee: Cree, Inc., Durham, NC (US)

( * ) Notice: Subject to any disclaimer, the term of this patent is extended or adjusted under 35 U.S.C. 154(b) by 184 days.

(21) Appl. No.: 14/813,595

(22) Filed: Jul. 30, 2015

(65) Prior Publication Data

US 2017/0030529 A1 Feb. 2, 2017

(51) Int. Cl.

| | |
|---|---|
| ***F21K 9/90*** | (2016.01) |
| ***F21K 9/232*** | (2016.01) |
| ***F21K 9/61*** | (2016.01) |
| *F21Y 115/10* | (2016.01) |
| *F21Y 113/13* | (2016.01) |

(52) U.S. Cl.

CPC ..... *F21K 9/90* (2013.01); *F21K 9/232* (2016.08); *F21K 9/61* (2016.08); *F21Y 2113/13* (2016.08); *F21Y 2115/10* (2016.08)

(58) Field of Classification Search

CPC ... F21K 9/90; F21K 9/61; F21K 9/232; F21Y 2113/13; F21Y 2115/10; F21V 5/00; F21V 5/007; F21V 5/02; F21V 5/048

See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |

(Continued)

FOREIGN PATENT DOCUMENTS

| | | | |
|---|---|---|---|
| EP | 1058221 | A2 | 12/2000 |
| EP | 0890059 | B1 | 6/2004 |

(Continued)

OTHER PUBLICATIONS

Cree, Inc.; U.S. Appl. No. 14/657,062, filed Mar. 13, 2015.

(Continued)

*Primary Examiner* — Bao Q Truong

(74) *Attorney, Agent, or Firm* — Dennis J. Williamson; Moore & Van Allen PLLC

(57) ABSTRACT

A small form factor LED lighting system provides for color-controlled dimming. Embodiments of the invention use one or more small-footprint LED(s) that can emit light of different correlated color temperatures (CCTs, colors or spectral outputs). The CCT of the fixture or bulb can change when dimmed by disproportionate adjustment of the driving power for each color. The small size and footprint of the LEDs enables use in decorative LED lamps, such as those designed to replace candelabra style incandescent bulbs. Various options can be used to tune the performance and lighting characteristics of a lamp according to embodiments of the invention, such as the use of differing LED device package optics, the use of reflective materials in and/or around LED device packages, and the use of a secondary optic to produce an omnidirectional light pattern.

20 Claims, 12 Drawing Sheets

(56) References Cited

U.S. PATENT DOCUMENTS

| | | | |
|---|---|---|---|
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |
| 6,227,679 | B1 | 5/2001 | Zhang et al. |
| 6,234,648 | B1 | 5/2001 | Borner et al. |
| 6,250,774 | B1 | 6/2001 | Begemann et al. |
| 6,276,822 | B1 | 8/2001 | Bedrosian et al. |
| 6,465,961 | B1 | 10/2002 | Cao |
| 6,523,978 | B1 | 2/2003 | Huang |
| 6,550,953 | B1 | 4/2003 | Ichikawa et al. |
| 6,634,770 | B2 | 10/2003 | Cao |
| 6,659,632 | B2 | 12/2003 | Chen |
| 6,709,132 | B2 | 3/2004 | Ishibashi |
| 6,803,607 | B1 | 10/2004 | Chan et al. |
| 6,848,819 | B1 | 2/2005 | Arndt et al. |
| 6,864,513 | B2 | 3/2005 | Lin et al. |
| 6,948,829 | B2 | 9/2005 | Verdes et al. |
| 6,982,518 | B2 | 1/2006 | Chou et al. |
| 7,048,412 | B2 | 5/2006 | Martin et al. |
| 7,080,924 | B2 | 7/2006 | Tseng et al. |
| 7,086,756 | B2 | 8/2006 | Maxik |
| 7,086,767 | B2 | 8/2006 | Sidwell et al. |
| 7,144,135 | B2 | 12/2006 | Martin et al. |
| 7,165,866 | B2 | 1/2007 | Li |
| 7,172,314 | B2 | 2/2007 | Currie et al. |
| 7,354,174 | B1 | 4/2008 | Yan |
| 7,396,142 | B2 | 7/2008 | Laizure, Jr. et al. |
| 7,600,882 | B1 | 10/2009 | Morejon et al. |
| 7,726,836 | B2 | 6/2010 | Chen |
| 7,824,065 | B2 | 11/2010 | Maxik |
| 7,965,023 | B1 | 6/2011 | Liang |
| 8,021,025 | B2 | 9/2011 | Lee |
| 8,154,181 | B1 | 4/2012 | Lin et al. |
| 8,198,819 | B2 | 6/2012 | Lenk |
| 8,253,316 | B2 | 8/2012 | Sun et al. |
| 8,272,762 | B2 | 9/2012 | Maxik et al. |
| 8,274,241 | B2 | 9/2012 | Guest et al. |
| 8,277,082 | B2 | 10/2012 | Dassanayake et al. |
| 8,282,249 | B2 | 10/2012 | Liang et al. |
| 8,282,250 | B1 | 10/2012 | Dassanayake et al. |
| 8,292,468 | B2 | 10/2012 | Narendran et al. |
| 8,322,896 | B2 | 12/2012 | Falicoff et al. |
| 8,371,722 | B2 | 2/2013 | Carroll |
| 8,400,051 | B2 | 3/2013 | Hakata et al. |
| 8,415,865 | B2 | 4/2013 | Liang et al. |
| 8,421,320 | B2 | 4/2013 | Chuang |
| 8,421,321 | B2 | 4/2013 | Chuang |
| 8,421,322 | B2 | 4/2013 | Carroll et al. |
| 8,421,329 | B2 | 4/2013 | Liang et al. |
| 8,427,037 | B2 | 4/2013 | Liang et al. |
| 8,449,154 | B2 | 5/2013 | Uemoto et al. |
| 8,502,468 | B2 | 8/2013 | Li et al. |
| 8,556,465 | B2 | 10/2013 | Lee et al. |
| 8,641,237 | B2 | 2/2014 | Chuang |
| 8,653,723 | B2 | 2/2014 | Cao et al. |
| 8,696,168 | B2 | 4/2014 | Li et al. |
| 8,740,415 | B2 | 6/2014 | Wheelock |
| 8,750,671 | B1 | 6/2014 | Kelly et al. |
| 8,752,984 | B2 | 6/2014 | Lenk et al. |
| 8,760,042 | B2 | 6/2014 | Sakai et al. |
| 8,866,385 | B2 | 10/2014 | Kitagawa et al. |
| 9,052,067 | B2 | 6/2015 | Van De Ven et al. |
| 9,192,016 | B1 | 11/2015 | Athalye et al. |
| D768,889 | S | 10/2016 | Bergmann et al. |
| 9,488,767 | B2 | 11/2016 | Nava et al. |
| 9,622,321 | B2 | 4/2017 | Creasman et al. |
| 9,702,512 | B2 | 7/2017 | Power et al. |
| 9,759,389 | B2 | 9/2017 | Bergmann et al. |
| 2004/0201990 | A1 | 10/2004 | Meyer |
| 2006/0238136 | A1 | 10/2006 | Johnson, III et al. |
| 2009/0184618 | A1 | 7/2009 | Hakata et al. |
| 2009/0212698 | A1 | 8/2009 | Bailey |
| 2011/0215345 | A1* | 9/2011 | Tarsa ..... F21V 3/02 257/88 |
| 2011/0273102 | A1 | 11/2011 | van de Ven et al. |
| 2012/0040585 | A1 | 2/2012 | Huang |
| 2012/0161626 | A1* | 6/2012 | van de Ven ..... F21V 3/02 315/35 |
| 2012/0287615 | A1* | 11/2012 | Kothari ..... F21L 13/00 362/192 |
| 2013/0026923 | A1 | 1/2013 | Athalye et al. |
| 2013/0026925 | A1 | 1/2013 | Ven et al. |
| 2013/0051002 | A1* | 2/2013 | Draper ..... F21V 29/004 362/231 |
| 2013/0069535 | A1 | 3/2013 | Athalye |
| 2013/0069547 | A1 | 3/2013 | van de Ven et al. |
| 2013/0093362 | A1* | 4/2013 | Edwards ..... H01L 25/0753 315/313 |
| 2013/0119872 | A1 | 5/2013 | Chobot |
| 2013/0127353 | A1 | 5/2013 | Athalye et al. |
| 2013/0162149 | A1 | 6/2013 | van de Ven et al. |
| 2013/0162153 | A1 | 6/2013 | van de Ven et al. |
| 2013/0169159 | A1 | 7/2013 | Lys |
| 2013/0293135 | A1 | 11/2013 | Hu et al. |
| 2013/0335966 | A1 | 12/2013 | Yokota et al. |
| 2014/0001959 | A1 | 1/2014 | Motley et al. |
| 2014/0043828 | A1 | 2/2014 | Yokota et al. |
| 2014/0063837 | A1 | 3/2014 | Rowlette, Jr. |
| 2014/0167620 | A1 | 6/2014 | Chobot |
| 2014/0167622 | A1 | 6/2014 | Chobot et al. |
| 2014/0167623 | A1 | 6/2014 | Chobot et al. |
| 2014/0167642 | A1 | 6/2014 | Chobot |
| 2014/0167653 | A1 | 6/2014 | Chobot |
| 2014/0268728 | A1* | 9/2014 | Hussell ..... F21K 9/90 362/225 |
| 2014/0268790 | A1 | 9/2014 | Chobot et al. |
| 2014/0293654 | A1 | 10/2014 | Kato et al. |
| 2015/0029733 | A1 | 1/2015 | Yoo et al. |
| 2015/0062892 | A1* | 3/2015 | Krames ..... H05B 37/0281 362/231 |
| 2015/0085492 | A1 | 3/2015 | Kato et al. |
| 2015/0351187 | A1 | 12/2015 | McBryde et al. |

FOREIGN PATENT DOCUMENTS

| | | | |
|---|---|---|---|
| EP | 2385400 | A2 | 9/2011 |
| EP | 2789893 | A1 | 10/2014 |
| GB | 2345954 | A | 7/2000 |
| JP | H09265807 | A | 10/1997 |
| JP | 2000173304 | A | 6/2000 |
| JP | 2001118403 | A | 4/2001 |
| WO | 0124583 | A1 | 4/2001 |
| WO | 0160119 | A2 | 8/2001 |
| WO | 2012011279 | A1 | 1/2012 |
| WO | 2012031533 | A1 | 3/2012 |
| WO | 2013086694 | A1 | 6/2013 |

OTHER PUBLICATIONS

USPTO; Non-Final Office Action for U.S. Appl. No. 14/657,062 dated Nov. 17, 2016, 22 pages.

Trade Show Hand-Out, "Looking for Partner," received on or before Feb. 10, 2015, 20 pages.

Cree, Inc., International Patent Application No. PCT/US2016/020581, International Search Report and Written Opinion, dated May 31, 2016.

Lextar Electronics Corporation, PC55H04 Product Specification, 2010.

U.S. Appl. No. 61/932,058, filed Jan. 27, 2014.

Philips, 40W Equivalent Soft White (2700K) B13 Blunt Tip Candle Dimmable LED Light Bulb (4-Pack), http://www.homedepot.com/p/Philips-40W-Equivalent-Soft-White-2700K-B13-Blunt-Tip-Candle-Dimmable-LED-Light-Bulb-4-Pack-435057/205362382.

Sylvania, Ultra 6-Watt (40W Equivalent) Candelabra Base Soft White Dimmable Decorative LED Light Bulb, http://www.lowes.com/pd_592629-3-79636_0_?productId =50222729.

TCP, 40W Equivalent Soft White (2700K) B10 Candelabra Dimmable LED Light Bulb (3-Pack), http://www.homedepot.com/p/

(56) References Cited

OTHER PUBLICATIONS

TCP-40W-Equivalent-Soft-White-2700K-B10-Candelabra-Dimmable-LED-Light-Bulb-3-Pack-RLDCT527KC3/205688945?N=5yc1vZbm79Z1z0u2lw.
U.S. Appl. No. 14/564,228, Office Action, dated Jul. 25, 2016.
U.S. Appl. No. 14/564,228, Final Office Action, dated Feb. 8, 2017.
U.S. Appl. No. 14/657,062, Office Action, dated Nov. 17, 2016.

* cited by examiner

SMALL FORM-FACTOR LED LAMP WITH COLOR-CONTROLLED DIMMING

BACKGROUND

Light emitting diode (LED) lighting systems are becoming more prevalent as replacements for legacy lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver any color light, and generally contain no lead or mercury. A solid-state lighting system may take the form of a luminaire, lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb. LED lamps often include some type of optical element or elements to allow for localized mixing of colors, collimate light, or provide a particular light pattern. Ideally, an LED lamp designed as a replacement for a traditional incandescent light source needs to be self-contained; needs to be dimmable; and needs to produce light that replicates that produced by a traditional incandescent bulb, especially where use in decorative fixtures is contemplated.

SUMMARY

Embodiments of the invention use an LED system approach with small-footprint LEDs producing light of different correlated color temperatures (CCTs, colors or spectral outputs) to allow the CCT of the bulb to change when dimmed by disproportionate adjustment of the driving power associated with different colors. In some embodiments, the small size of the LEDs allows embodiments of the invention to be used in small, decorative LED lamps, such as those designed to replace candelabra style incandescent bulbs. Various options can be used to tune the performance and lighting characteristics of a lamp according to embodiments of the invention, such as the use of differing LED device package configurations and features, the use of reflective materials, and the use of a guide optic to produce a more natural, omnidirectional light pattern.

Embodiments of the present invention can provide a lamp including at least one LED to provide light of at least two spectral outputs. In some embodiments, an optic receives the light from the at least one LED, for example, by being installed over a mounting surface for the LED or LEDs. This optic may be referred to herein as a guide optic or a secondary optic. In some embodiments this secondary optic has a stem that is narrower than the mounting surface. At least a portion of the light from the LEDs travels through the guide optic, and the light is emitted from the lamp with a correlated color temperature of from 1200K to 3500K that is reduced when the lamp is dimmed. In some embodiments, the lamp is a candelabra lamp that is configured to act as and/or that has the form factor of a standard, incandescent candelabra bulb, though the arrangements of optics and LEDs described herein are not limited to lamps of any specific size or to LEDs of any specific spectral outputs unless expressly stated. In some embodiments the LED or LEDs are disposed on the mounting surface within a 7 mm footprint. In some embodiments the LED or LEDs are disposed on the mounting surface within a 4 mm footprint.

In some embodiments, the solid-state lamp uses an LED including a plurality of LED chips in a single LED device package, or a single LED die with multiple areas of light emission and/or phosphor in a single LED device package. As an example, a single package can include four LED chips, where two have one spectral output and are responsible for producing one color of light and two have another spectral output and are responsible for producing the other color of light. Alternatively, at least two LED chips can be disposed one each in individual LED device packages and a plurality of LED device packages (or LEDs) can be used. In some embodiments, the LED device packages can use at least two differently shaped lenses or primary optics, for example, a domed lens or first primary optic and a cubic lens or second primary optic. In some embodiments, two LED device packages have the domed lens and two LED device packages have the cubic lens. The lenses of a given shape can be used with LEDs that are used to produce a single color, or two LEDs that emit light of two different colors of spectral output. The colors can be phosphor converted or be produced by single color LEDs and the arrangements described herein of LEDs of different spectral outputs are not limited any particular colors of LEDs or to any particular size of LED lamp unless expressly stated. The lenses cause the LEDs to have two different far field patterns, where the first primary optic has a first far field pattern that is narrower than a second far field pattern of the second primary optic. In some embodiments, the lamp can include a reflective material between and/or around the LED chips. This reflective material can include a white or otherwise reflective solder mask encroaching on LED device packages and/or a structural component of the LED device packages such as a white or otherwise reflective sidewall or submount. Reflective material can be either specular or diffuse, and can have a reflectivity of at least 85% or at least 90%. In an embodiment with multiple LED device packages, a reflective dam can alternatively be provided between and/or around the LED device packages.

A solid-state candelabra lamp according to example embodiments of the invention can include a power supply within the base of the candelabra lamp. The LED or LEDs with different spectral outputs can be connected to the power supply and the power supply is operable to selectively dim the spectral outputs when the candelabra lamp is dimmed. One, two, three, four or more different color LEDs can be used and the LEDs can be organized into strings such that one LED string contains LEDs of a given spectral output. Thus, one color of LEDs or LED chips may have a different dimming profile from the other color. A guide optic can direct and mix some of the light from the LED or LEDs and an optically transmissive enclosure can enclose the light emitters and the guide optic so that the light is emitted from the lamp with an illumination pattern similar to that of an incandescent bulb. The lamp can also have a CCT of from 1200K to 3500K and the CCT is reduced when the candelabra lamp is dimmed, which is also similar to an incandescent bulb.

In accordance with another aspect of the present invention which can be used alone or in combination with other aspects of the present invention, a lighting device is provided that comprises at least one first LED comprising a first primary optic that produces light with a first far field pattern and at least one second LED comprising a second primary optic that produces light with a second far field pattern that is different from the first far field pattern. A secondary optic, such as a lens, waveguide or diffuser, is disposed to receive the light from the at least one first and second LEDs. Such an arrangement can provide improved light mixing and uniformity. In some embodiments, the at least one first and second LEDs have different spectral outputs, and this arrangement can provide improved color mixing.

DETAILED DESCRIPTION

Figure 1:
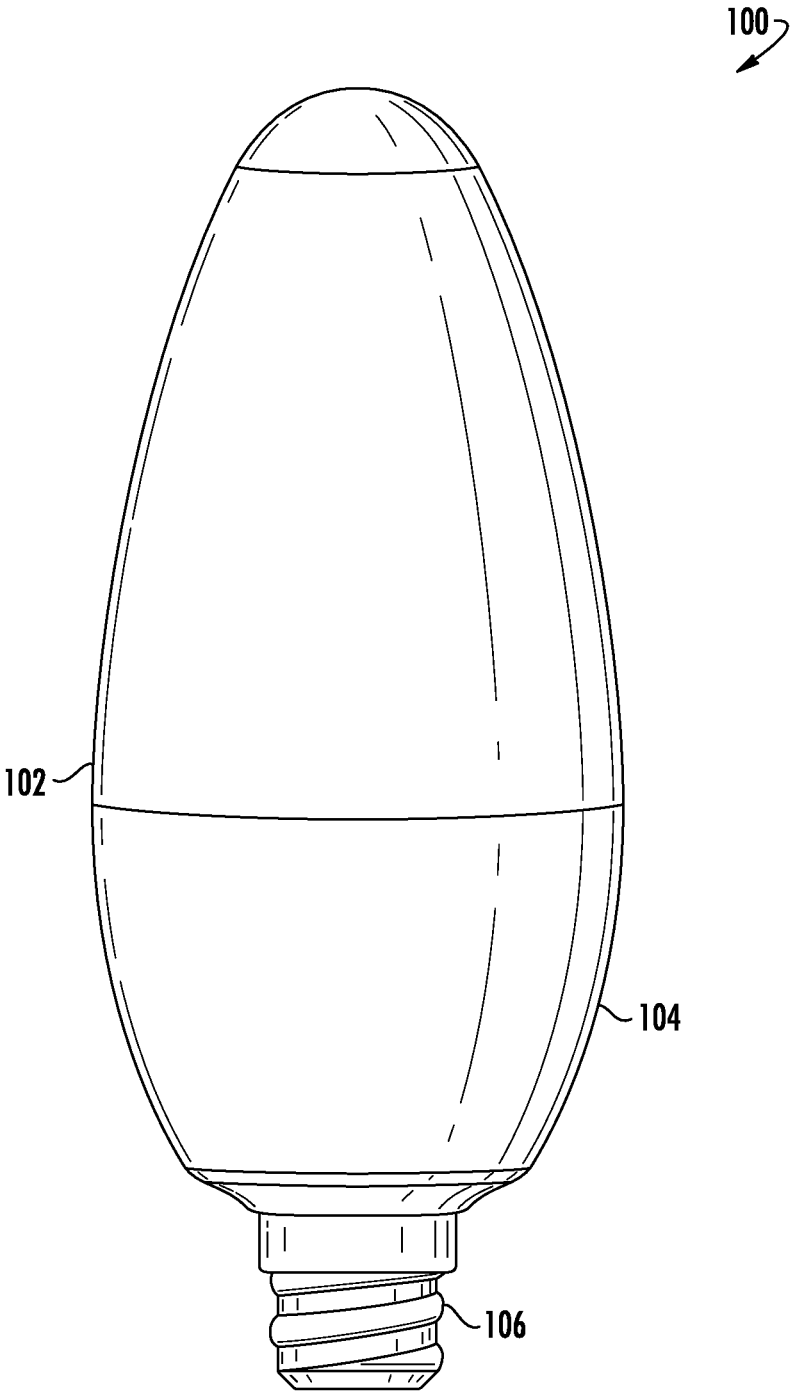
FIG. 1 is an external side view of a solid-state, LED candelabra lamp according to embodiments of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid-state light emitter" or "solid-state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid-state light emitters and/or multiple lumiphoric materials (i.e., in combination with at least one solid-state light emitter) may be used in a single device, such as to produce light perceived as white or near-white in character. In certain embodiments, the aggregated output of multiple solid-state light emitters and/or lumiphoric materials may generate warm white light output having a color temperature range of from about 2700K to about 4000K.

Solid-state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid-state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials may be associated with a lumiphor, a lumiphor binding medium, or a lumiphor support element that may be spatially segregated from a solid-state emitter.

For purposes of the discussion herein, the term "LED" will typically be used to refer to an entire light emitting device, meaning a device package with any chips and any optics that are a permanent part of the device package. The term in some cases may be used to refer to the semiconductor die or LED chip. An LED device package may have a single LED chip with a single light emitting area with our without a lumiphor, a plurality of LED chips, where some or all may have a lumiphor associated therewith, or a single LED chip with multiple light emitting areas. Such a chip may, for example, consist of a common substrate with multiple PN junctions and a local area of phosphor may be associated with one, some, or each of the PN junctions.

It should also be noted that the term "lamp" is meant to encompass not only a solid-state replacement for a traditional incandescent bulb as illustrated herein, but also replacements for fluorescent bulbs, replacements for complete fixtures, and any type of light fixture that may be custom designed as a solid state fixture.

As previously mentioned, some embodiments of the invention can be especially useful in SSL bulbs dimensioned to replace small, decorative incandescent bulbs, such as candelabra bulbs, although an embodiment of the invention can find use in any size or shape of LED lamp and with LEDs with any combination of spectral outputs. FIG. 1 illustrates an LED candelabra lamp/bulb 100 according to embodiments of the present invention. Lamp 100 includes an optical enclosure 102 covering the LED(s), a driver base 104, and an Edison-style screw connector 106. Lamp 100 follows the form factor of a standard, incandescent candelabra bulb, which is commonly referred to in lighting parlance as an E12 bulb. A bulb with a larger "Edison screw" connector but similar in other respects might be referred to as an E26 bulb, and embodiments of the invention would also work in a lamp designed to replace such a bulb, as well as in lamps with a variety of other form factors.

Figure 2:
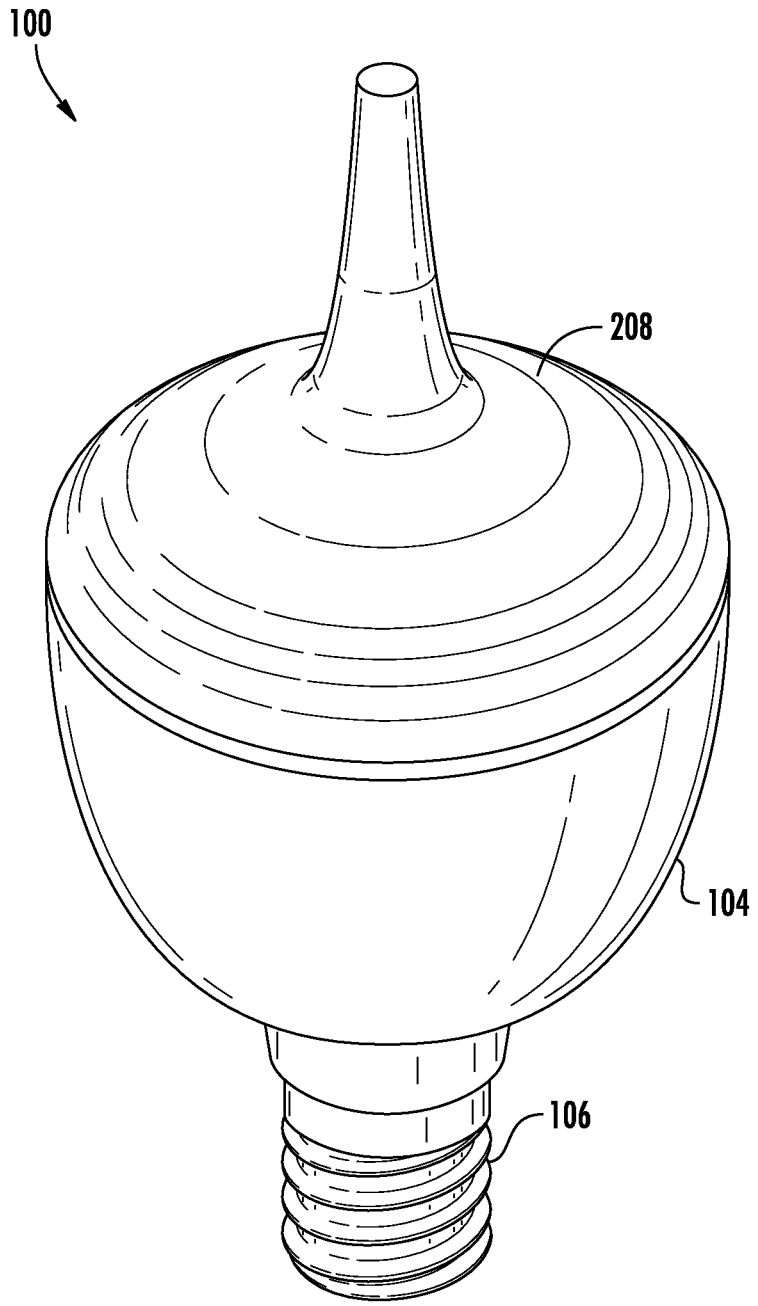
FIG. 2 is a perspective view of the LED lamp of FIG. 1 with the light transmissive enclosure removed.

FIG. 2 is a perspective view of the entire base of the candelabra lamp of FIG. 1 with the optical enclosure or "dome" removed so that the overall shape of a guide optic 208 is visible. The optical dome or "optically transmissive enclosure" can be fastened with adhesive or fasteners on top of the guide optic, and can be designed so that the edges that rest on the guide optic are angled and are either light transmissive or opaque. If the edges of the dome are light transmissive the dome may be transmissively coupled into the guide optic.

Figure 3:
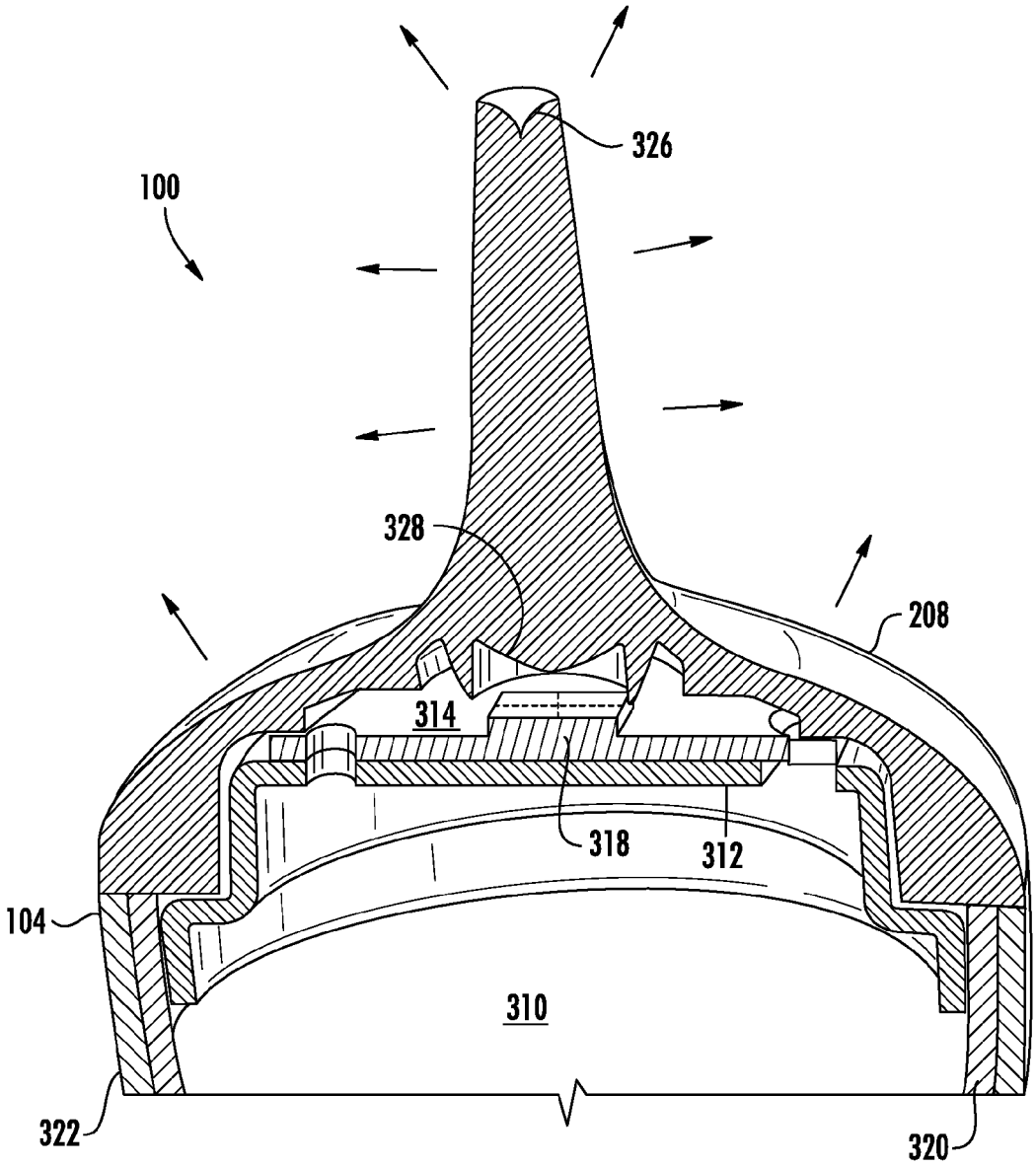
FIG. 3 is a cross-sectional perspective view of the LED lamp of FIGS. 1 and 2 so that the internal detail of the lamp may be seen.

FIG. 3 is a view of solid-state lamp 100 with all the parts of the bulb cut away, the optical dome removed, and the power supply components removed from power supply shell 310. In the working lamp, power supply components, including those for controlling current in the LEDs according to embodiments of the invention, are installed in the base, and may be potted or otherwise be made conforming to the shape of the base of the lamp. A power supply may also be referred to as a "driver" and thus the base of a lamp like lamp 100 may be referred to as a "driver base." The base of lamp 100 as visible in FIG. 3 includes support 312 and circuit board 314, which forms a mounting surface on which an LED or LEDs 318 can reside. The power supply in the base is normally connected to the LED(s) through wiring in the circuit board, which in turn is connected to the power supply through wires (not shown) running through support 312. Details of possible LED device package mounting configurations for a lamp like lamp 100 are discussed below in reference to FIGS. 4, 6, and 7. There can be one or multiple LED device packages, but with embodiments of the invention there may be multiple light sources as indicated by the dotted lines in the figure.

It should be noted that driver base 104 of lamp 100 can be constructed in various ways. As shown in FIG. 3, the driver base has two structural layers, 320 and 322. A driver base could be made with one shell. In this case, there is an inner shell 320 made of metal such as aluminum and an outer plastic shell 322. In some embodiments the outer shell is opaque, but in others it is clear and serves as an angular distribution optic, conducting some light from guide optic 208 towards the bottom of the lamp where it is emitted so that the entire lamp appears to emit light as is the case with a traditional incandescent bulb. Use of an optical bottom shell in a candelabra-style, solid-state lamp is discussed in U.S. patent application Ser. No. 14/657,062 filed Mar. 13, 2015, the entire disclosure of which is incorporated herein by reference.

Still referring to FIG. 3 guide optic or secondary optic 208 has an elongated portion that directs some light into the optically transmissive dome enclosure 102. In some embodiments, the bottom of the guide optic may direct light into an angular distribution optic. Light emanates from the top portion of the secondary optic and out through optically transmissive enclosure 102 as shown by the arrows in FIG. 3, resulting in a natural, pleasing light pattern, especially for a bulb that may be installed in an open or transparent fixture. The vertical part of guide optic 208 in this example embodiment is tapered, and includes internally reflective surface 326 at the top end. The vertical part of the optic can also be referred to as an "optical tower" or a "stem" and in this example has a diameter of about 3.4 mm at the top end. In some embodiments, the stem is narrower than the mounting surface for the LEDs, from this top portion all the way to its bottom, which is where its curvature mathematically disappears into that of the shell that covers the driver base. In some embodiments exit surface 326 follows a parabolic curve. Entry surface 328 directs light rays as appropriate to exit the guide optic at the top and sides to direct light through optically transmissive enclosure 102 and eventually emanate from the bulb.

The light guide portion of the secondary optic is configured so that some light propagates up the light guide through internal reflection while some light may escape the sides of the light guide. Depending on the design of the light guide, more of the light can be guided through internal reflection to the extraction surface at the end of the light guide. To further extract light along the length of the light guide, extraction surfaces can be positioned along the length of the light guide and/or at one end of the light guide. It should be noted that while the secondary optic of FIG. 3 is pictured in a candelabra lamp, the same type of optic can be used in a lamp of any size and with any LEDs of any spectral output or combination of spectral outputs.

Figure 4:
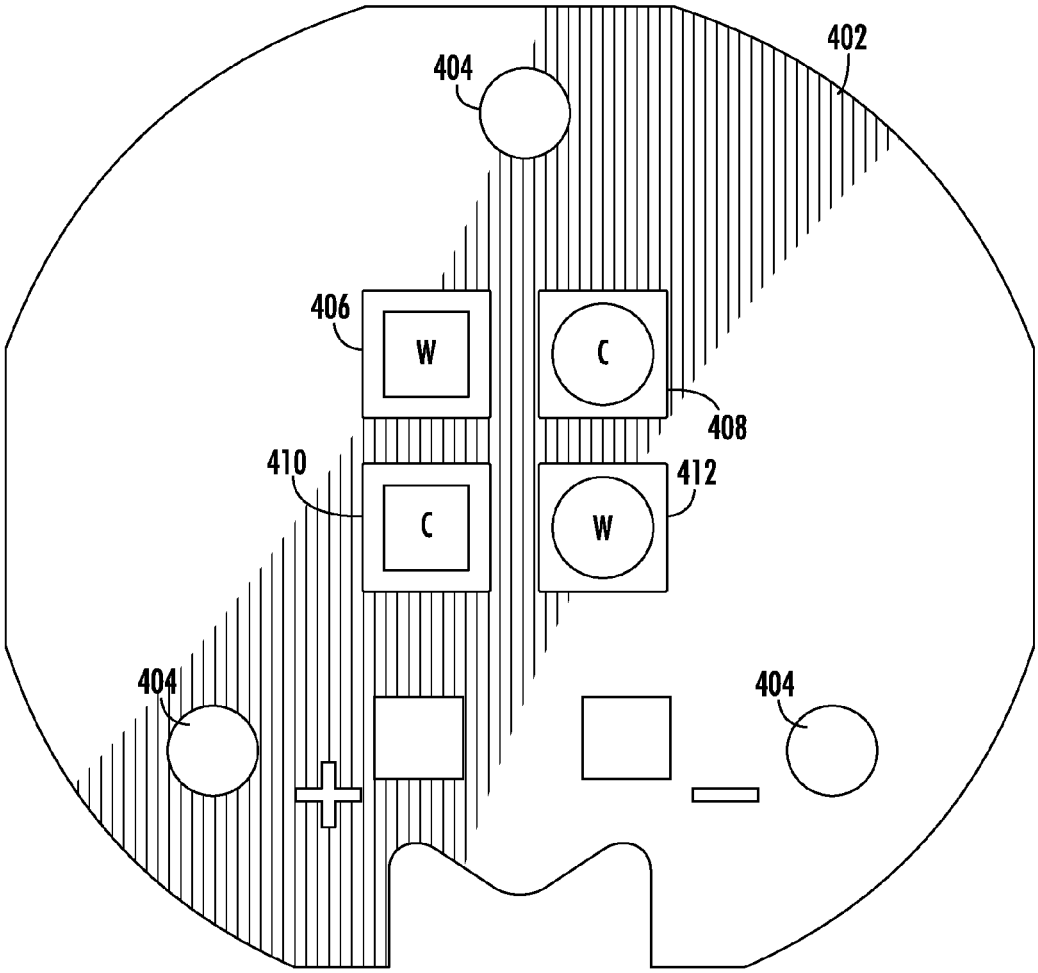
FIG. 4 is a top view of LEDs on the mounting surface of a circuit board within the lamp of some embodiments of the present invention.

FIG. 4 is a top view of circuit board 402, on which LED device package(s) can be mounted under a guide optic and serve as a light source for a lamp like that illustrated in FIGS. 1, 2, and 3 according to some embodiments of the invention. Note that sizes and spacing of LED devices are enlarged for clarity. The figures are schematic in nature and may not be to scale. Circuit board 402 includes mounting holes 404 and power pads as indicated with plus and minus signs. As previously discussed, a lamp according to this example embodiment has at least two light emitting areas with two different spectral outputs to provide light of at least two different colors. In this particular embodiment, the lamp has four LED device packages, 406, 408, 410, and 412, disposed on the mounting surface of the circuit board so that the guide optic receives the light from the LEDs. Each device package in this example contains a single LED chip. Each LED chip with any associated phosphor can be referred to herein as a light emitter. In some embodiments, each device package is roughly 1.6 mm square and the gaps between them are roughly 0.4 mm wide, so that the LEDs with differing spectral outputs (possibly after phosphor conversion within the device package) fit within a square "footprint" on the mounting surface that is from 3.6 mm to 4 mm on a side. In some embodiments, the LED device packages can be laid out in an irregular pattern, but if at least one dimension of the footprint is kept to this range, the footprint can be referred to by this size and the LED assembly can work in smaller, decorative lamps such as the candelabra lamp described herein.

Still referring to FIG. 4, at least a portion of the light from the device packages travels through the guide optic, and light can generally be emitted from a lamp with a correlated color temperature of from 1200K to 3500K, depending on the CCTs of the LED devices used. In this particular example, the color of the light produced by the LEDs is indicated by the letters "w" for warmer and "c" for cooler. In addition, device packages 406 and 410 each have a cubic lens and device packages 408 and 412 each have a domed lens. In this example embodiment, the cooler LEDs emit light with a CCT of 3200K and the warmer LED devices emit light with a CCT of 2200K, both with a color rendering index (CRI) of 90. By disproportionate dimming of the LED devices relative to their spectral output, the color temperature of the light from the lamp can be reduced along with the light output when the lamp itself is dimmed. The mechanism for such dimming will be discussed below with reference to FIG. 9. Note a mixture of LEDs with differing spectral outputs where the CCT of the lamp changes when dimmed can be implemented in many kinds and sizes of LED lamps with various LED spectral outputs.

Figure 5A:
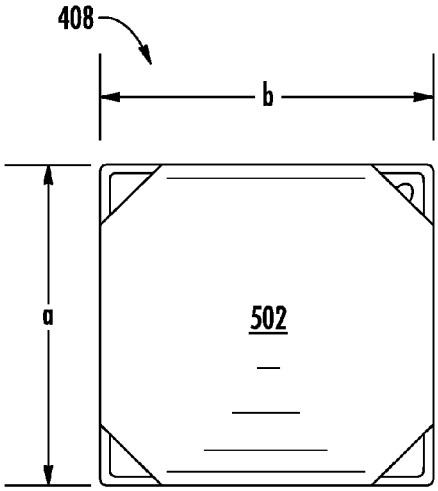
FIG. 5A and FIG. 5B are top and side views, respectively, of an LED device package that may be used with embodiments of the present invention.
Figure 5B:
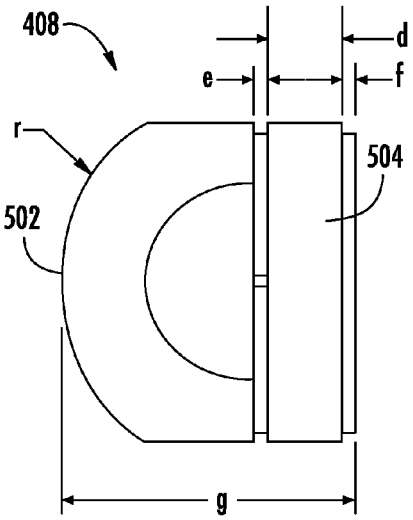

FIGS. 5A and 5B are a top view and a side view, respectively, of LED device package 408 from FIG. 4, that is, an LED device package with a domed lens. LED device package 412 would have the same dimensions. As previously mentioned, dimensions a and b are approximately 1.6 mm. The top part of domed lens 502 has a radius r of approximately 0.936 mm. The thickness d of sub mount 504 is approximately 0.375 mm, and the submount has metal layers on the top and bottom having thicknesses e and f of approximately 0.063 mm. Finally, the overall height g of device package 408 (and device package 412) is about 1.44 mm. It should be noted that domed lens 502 may be referred to as a "truncated" dome since the sides of the lens are flat.

Figure 6A:
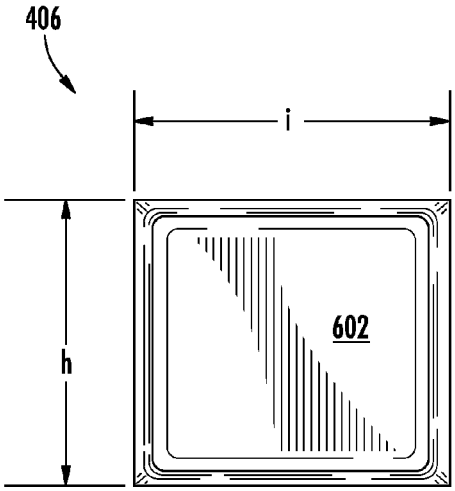
FIG. 6A and FIG. 6B are top and side views, respectively, of another LED device package that may be used with embodiments of the present invention.
Figure 6B:
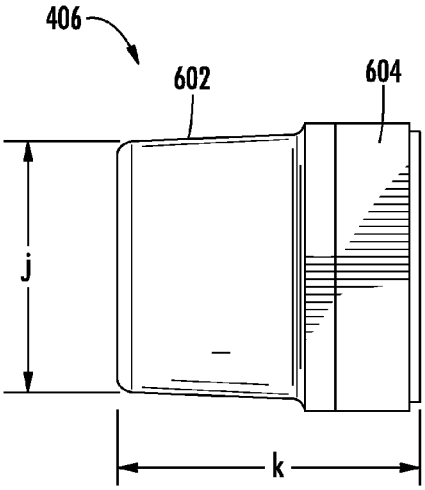

FIGS. 6A and 6B are a top view and a side view, respectively, of LED device package 406 from FIG. 4, that is, an LED device package with a cubic lens 602. Note that the lens does not form a perfect cube, or even part of a perfect cube as the sides are slightly tapered. The term "cubic" is used herein only to refer to the general shape, namely that having a flat top as opposed to a curved top. Also note that LED device package 410 would have the same dimensions. As previously mentioned, dimensions h and i are approximately 1.6 mm. The thicknesses of submount 604 and its metal layers are approximately the same as for the domed device package already discussed. The upward taper of the cubic lens 602 of LED device packages 406 and 410 cause the width j of the top of the lens to be less than the footprint dimension of the device. In this example the width j of the top of the lens is about 1.41 mm. The overall height k of device package 406 (and device package 410) is about 1.6 mm. LED device packages like those above can be realized with XQ series LEDs manufactured by Cree, Inc. in Durham, N.C., USA.

As can be readily observed, the LED devices packages described above have differently shaped lenses, also referred to as primary optics. It has been found that the ability to "tune" the angle of light entering the guide optic with device package lens geometry allows for achieving an appropriate light distribution pattern from the lamp given engineering trade-offs that may result from the use of various materials and shapes for the optical elements. In the particular example above, the domed device package, with a first primary optic that is dome-shaped, emits light over a narrower angle of about 115° to about 120°. This angular pattern can be referred to herein as a first far field pattern. The cubic package, with a second primary optic that is roughly cubic in shape, emits light over a wider angle, from about 135° to about 140°. This wider angular pattern can be referred to herein as a second far field pattern. The combination of light within the secondary (guide) optic having these two different angular emission patterns results in even lighting from the lamp. That is, light will evenly distributed around the sides and over the top of a lamp, more closely mimicking the light pattern of a traditional, incandescent bulb. A designer can "tune the design of the lamp by using primary optics with different far field patterns by applying the each type of primary optic to LEDs of the same spectral output or across LEDs with differing spectral outputs, and those spectral outputs can be produced by phosphor conversion and/or by saturated, single-color LEDs. It is also possible to use LEDs of three or more differing spectral outputs and primary optics of more than two different far field patterns to obtain various results.

Figure 7:
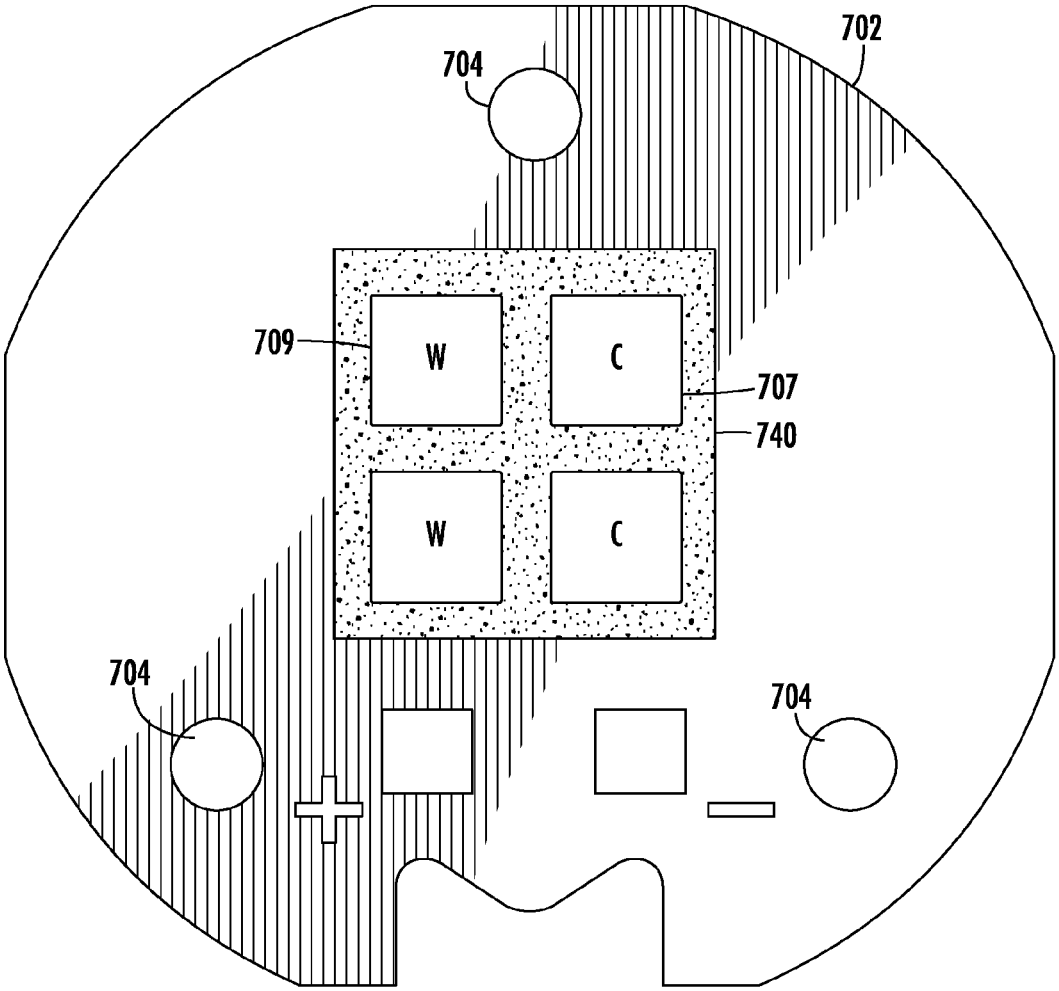
FIG. 7 is a top view of LEDs on the mounting surface of a circuit board with reflective material between and around the LED device packages according to example embodiments of the present invention.

FIG. 7 is a top view of circuit board 702 on which LED device packages are mounted under the guide optic to serve as a light source for a lamp similar to that illustrated in FIGS. 1, 2, and 3. Four LED device packages are installed on circuit board 702. Circuit board 702 includes mounting holes 704 and power pads as indicated with plus and minus signs. In the embodiment of FIG. 7 however, larger LED device packages having a measurement of about 3 mm on a side are used, and these packages have identical optics, although larger packages with differing primary optics as previously described could be used. In this example embodiment, the cooler LEDs 707 emit light with a CCT of 3200K and the warmer LED devices 709 emit light with a CCT of 2200K. The LEDs have a space between them of from 0.4 to 1 mm, so that the footprint in this example is from 6.6 mm to 7 mm. In some embodiments, a lamp using an arrangement like that pictured in FIG. 7 has reflective material between and/or around the plurality of LED chips within the LED device packages. This reflective material can include material 740, which in some embodiments is a white or otherwise reflective solder mask. Alternatively, or in addition, LED devices 707 and 709 may include additional white or otherwise reflective material through the use of a reflective structural component. Such a reflective structural component can as an example include the package sidewalls, either by way of a coating or by use of a reflective submount, such as one made of alumina. It has been found that reflective material in the area of the LED chips improves the light output of a candelabra bulb according to embodiments of the invention. The reflective material may be specular or diffuse. In some embodiments the material has a reflectivity of at least 85%. In some embodiments, the material has a reflectivity of at least 90%. It has been found that with Cree XHG LEDs, a white solder mask encroaching on the LED device packages improves the light output of a lamp according to embodiments of the invention by eliminating dark recesses that could otherwise absorb light. A package with highly reflective interior and exterior surfaces (aka walls) can be used, where the high reflectively of the external surfaces serves to reduce the loss from light impinging on it from neighboring LED packages and reflections from secondary optic surfaces. In a dense-packed geometry as described here, there is a significant amount of light that circulates throughout the volume and optical lose can be prohibitively high if the elements are not highly reflective (where the elements include the LED packages themselves as well as the printed circuit board, etc.).

In some embodiments, the reflective material 740 can be or include a reflective dam installed or deposited between and/or around the LED device packages. Such an embodiment is useful for LED device packages with dark submounts. The reflective dam may be made of solid plastic, raised metallization, or a white, silver or otherwise reflective material deposited around the LED device packages. The reflective dam may be designed so that the material resides only between the device packages, only around the device packages, or in both areas. In example embodiments, the reflective dam is composed of titanium dioxide and is deposited both in and around the LED device packages. It has been found that with Cree XQ series LEDs, that titanium dioxide in the area of the LED device packages improves the light output of a candelabra bulb according to embodiments of the invention.

Figure 8:
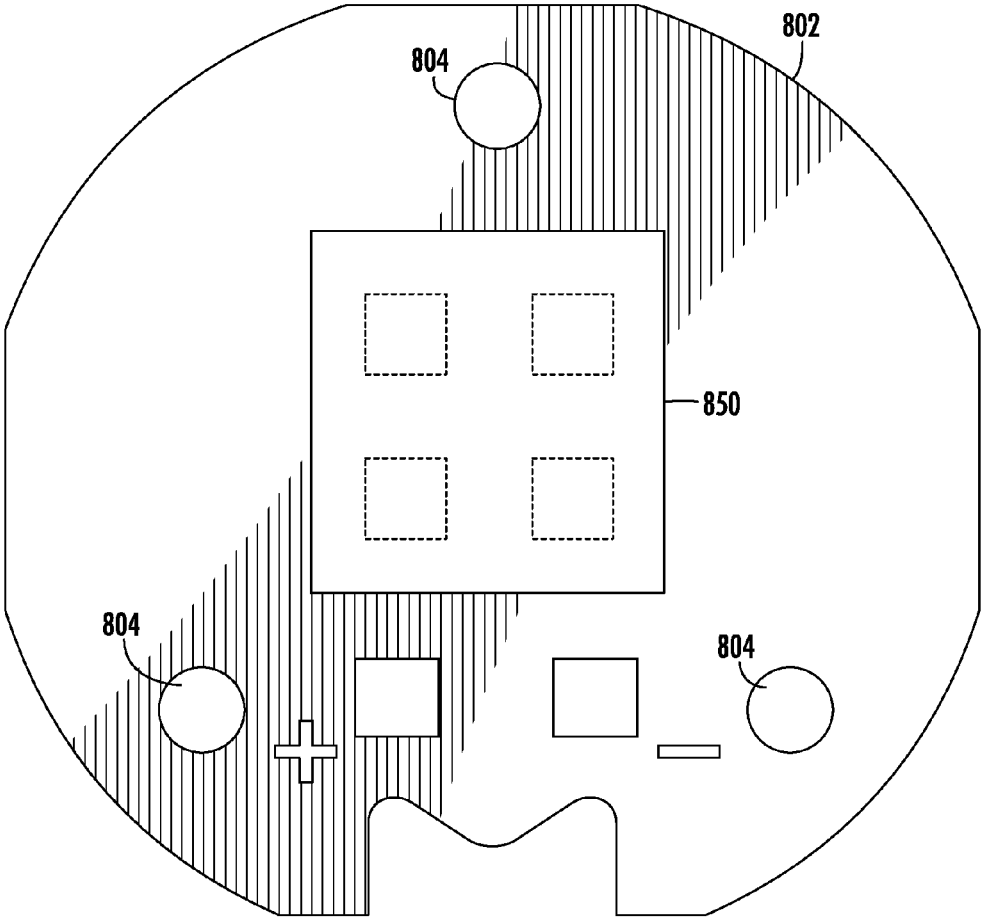
FIG. 8 is a top view of a single LED on the mounting surface of a circuit board within the lamp of some embodiments of the present invention.

FIG. 8 is a top view of circuit board 802, on which an LED device package with multiple, individually controllable spectral outputs can be mounted under a guide optic and serve as a light source for a lamp, such as the lamp illustrated in FIGS. 1, 2, and 3. The figure is schematic in nature and may not be to scale. Circuit board 802 includes mounting holes 804 and power pads as indicated with plus and minus signs. As previously discussed, a lamp according to this example embodiment of the present invention has at least two differing spectral outputs. In some embodiments, a plurality of LED chips is disposed in a single LED device package 850, and the package is wired so that LED chips are individually addressable. As before, the package should occupy a relatively small footprint for use in a small, decorative lamp as previously described. In this particular embodiment, the lamp has four LED chips in the device package, and their positions are roughly indicated by dotted lines. In some embodiments, LED 850 is an MHB series LED from Cree. As before, portion of the light from the LED chips travels through the guide optic, and light can generally be emitted from a small lamp with a correlated color temperature of from 1200K to 3500K, depending on the CCTs of the LEDs used. In this example, cool LEDs cause the emission of light with a CCT of 3500K and warm LEDs cause the emission of light with a CCT of 2200K, both with a color rendering index (CRI) of 90. Phosphor on the chips or otherwise disposed in the LED device package may be used to render these colors from the LEDs. By disproportionate dimming of the light emitters relative to the CCT of their light, the color temperature of the light from the lamp can be reduced along with the light output when the lamp itself is dimmed. The mechanism for such dimming will be discussed below with reference to FIG. 9.

Still referring to FIG. 8, in some embodiments LED device package 850 includes a single, LED die with multiple, individually addressable color emitting regions. In such a case the device substrate the package are wired so that the spectral outputs produced are individually addressable. In some embodiments, these color emitting regions are implemented by multiple PN junctions formed on a single semiconductor substrate. One, some, or all of the PN junctions may have an area of phosphor associated with it to provide the desired spectral output. Again the positions of the emitting regions and phosphor, if present are roughly indicated by dotted lines. Regardless of whether individual LED chips or light emitting regions on a single substrate are being used, each LED PN junction, with its phosphor if present, can be described herein as a light emitter.

As is well known in the lighting arts, the color temperature of an incandescent light bulb changes as the bulb is dimmed. This change typically amounts to several hundred degrees K of color temperature. The specifics vary from one type of bulb to another, but as an example, a typical household incandescent "Edison" style bulb has a full illumination temperature of about 2700° K and dims to a warmer 2200° K at about 10% of full illumination. LEDs typically actually grow cooler in color temperature as drive current is reduced. Thus, simply dimming an LED light source in the same manner as an incandescent bulb produces an unnatural result with respect to color temperature change. Embodiments of the present invention produce a more natural warming of the color temperature of a lamp when the lamp is dimmed.

Figure 9:
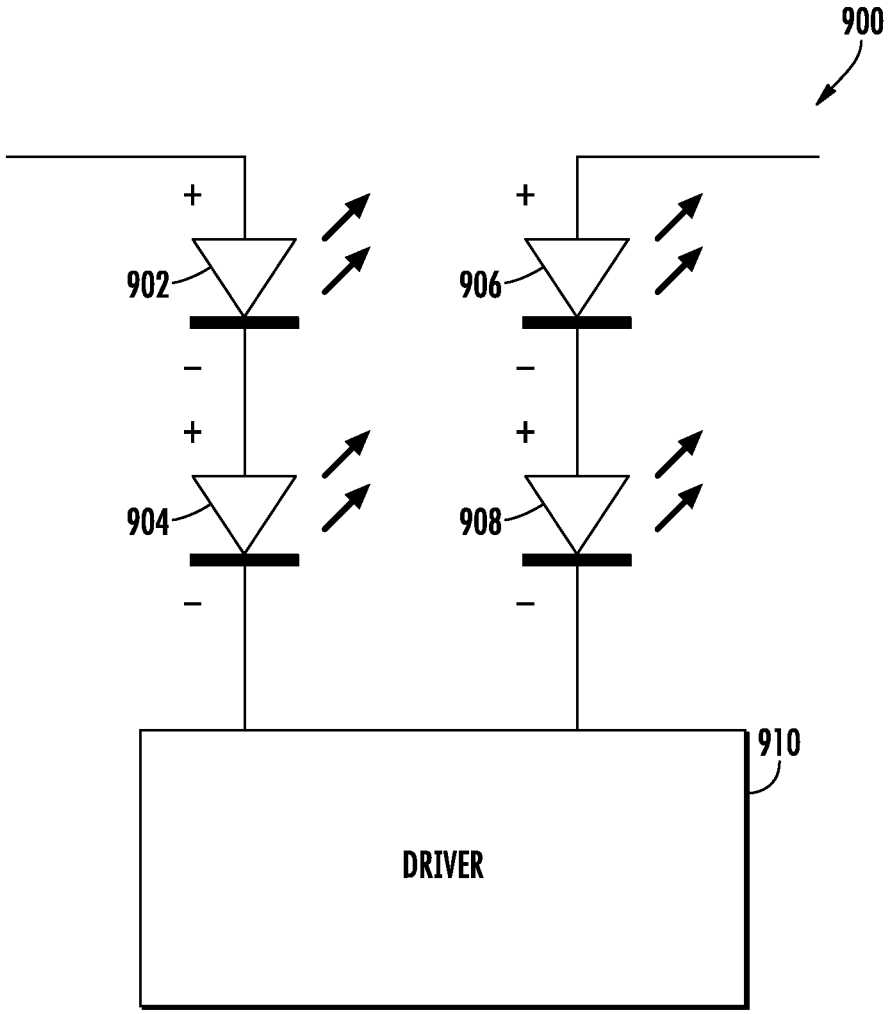
FIG. 9 is an electronic schematic diagram illustrating a portion of the circuitry of a lamp according to at least some embodiments of the present invention.

FIG. 9 illustrates the circuit configuration 900 used in the example candelabra lamp described with respect to FIGS. 1-4. Light emitters 902 and 904 are warm LEDs or addressable areas of a chip as previously described. LEDs 906 and 908 are cool LEDs or addressable areas of a chip as previously described. Driver 910 individually addresses the two strings of light emitters. When the line voltage input (not shown) to driver 910 is reduced due to manipulation of a dimmer in the circuit, the driver reduces the drive current of the cool light emitters more so than the drive current of the warm light emitters. This disproportionate change in the drive current of the cool and warm strings of light emitters causes the overall light from the lamp to become warmer as the lamp is dimmed in much the same way that the color of light from an incandescent bulb warms when the bulb is dimmed. In example embodiments of the invention, 30 V light emitters are used in the LED device package or packages. Thus, each string is powered by 60 V. However, various types of LED devices can be used to implement an embodiment of the invention, including both lower and higher voltage LEDs.

Driver 910 of FIG. 9 includes the control circuitry to manage the disproportionate dimming of the LED strings; however, the control circuitry could be separated from the driver and, for example, mounted on the circuit board with the LEDs inside the lamp. The control circuitry can include, for example, a microcontroller that directs a separate driver circuit for each string of light emitters, possibly in accordance with feedback from an internal light sensor. In a candelabra LED lamp, at least most of the driver or power supply would normally be assembled within or conforming to the base of the lamp. The LED or LEDs is/are connected through the previously discussed circuit board to the power supply to be operable to provide the light of at least two different colors where the power supply selectively dims at least some of the light emitters when the lamp is dimmed through an architectural control in the same manner as an incandescent bulb would normally be dimmed. The guide optic receives some of the light and in part, along with the optically transmissive dome or enclosure, enables an omnidirectional, natural light pattern.

In example embodiments, light is emitted from the lamp with a correlated color temperature of from 1200K to 3500K that is reduced when the lamp is dimmed. A lamp can also operate at a color temperature from 2000K to 3000K, where the color temperature is reduced when the lamp is dimmed. In a specific example, the CCT of the light from the lamp is about 2700K and dims to about 2200K at 10% power, much the same as a typical incandescent bulb. This dimming profile is accomplished using LEDs with a spectral output having a CCT of about 2200K in combination with LEDs having a spectral output having a CCT of about 3200K, meaning the cooler light emitter is essentially shut off at full dimming. Various types of LED devices can be used and driving circuitry modified accordingly to alter these color temperatures.

The warmer and cooler LEDs or devices can be any of various spectral outputs. As additional examples, the spectral outputs with CCTs of 1800K and 2700K can be used. A lamp with such devices may produce generally warmer light at full brightness and would then become warmer still when dimmed as described herein. Single colors and non-phosphor converted colors can also be used. For example, a red LED device can be used with a substantially white LED device, wherein the light from the red LED device becomes a larger component of the output of the lamp when the lamp is dimmed. Additional single or saturated color LEDs can be added to fill-in portions of the light spectrum to make for more pleasing light or a higher CRI for the lamp. White light devices with spectral outputs having CCTs anywhere from 1200K to 5000K can be used together. As an example, a warmer LED might have a spectrum that runs from about 1200K to about 2700K, or be an appropriate single color or saturated color device and a cooler LED might have a spectrum that runs from about 2200K to about 5000K or be an appropriate single color or saturated color device. In some embodiments, a warmer LED might have a spectrum that runs from about 1200K to about 2200K, or be an appropriate single color or saturated color device and a cooler LED might have a spectrum that runs from about 2700K to about 3500K or be an appropriate single color or saturated color device.

In some embodiments, a lamp like that described in most respects can include 3, 4, or more LEDs or LED strings, where the LEDs of each string (even if a string only includes a single LED) have different spectral outputs. Such an embodiment would allow for more finely tuned color changes when dimming or under different conditions. As an example LEDs with CCTs of 1800K, 2200K, 3200K, and 3600K can be used in an embodiment based on four different spectral outputs. Such an arrangement can be used, as an example to create a very reddish low candlelight color when moving from 2200K to 1800K during the dimming process.

Figure 10:
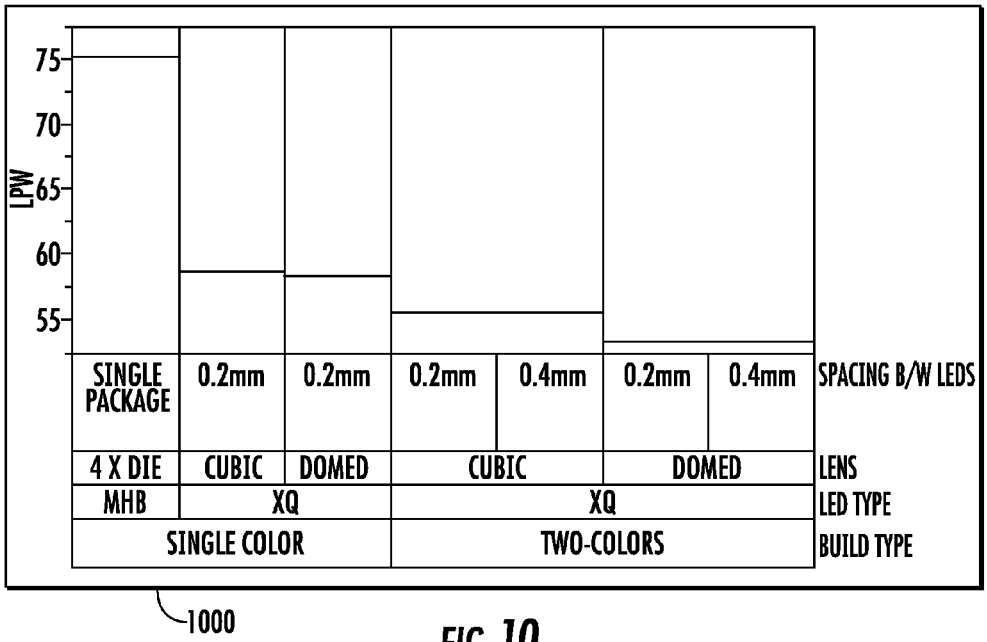
FIG. 10 is a graph showing the efficiency of various configurations of an LED lamp according to example embodiments of the invention.
Figure 11:
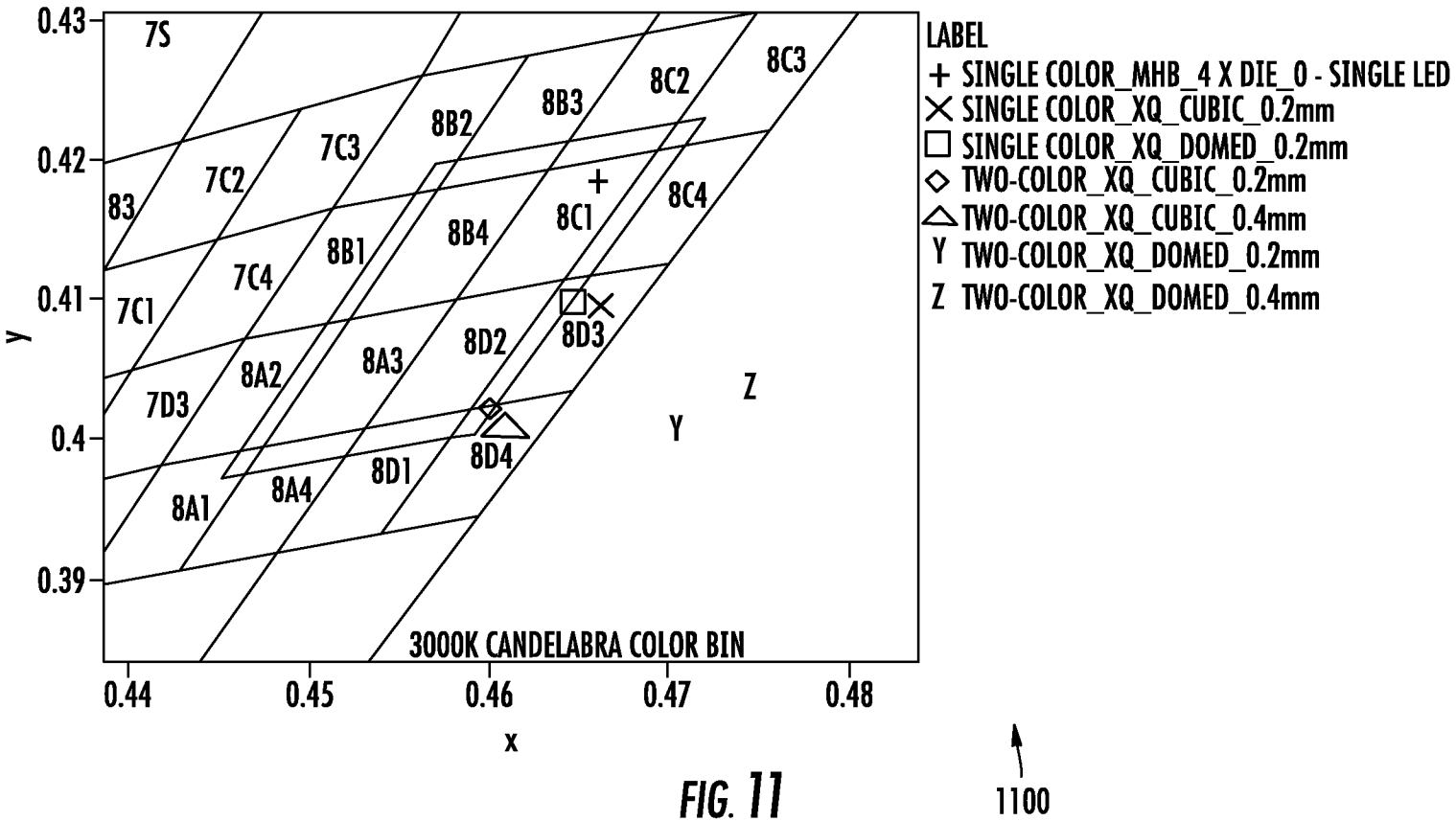
FIG. 11 is a color bin diagram for the LED lamp configurations referred to in FIG. 10.
Figure 12:
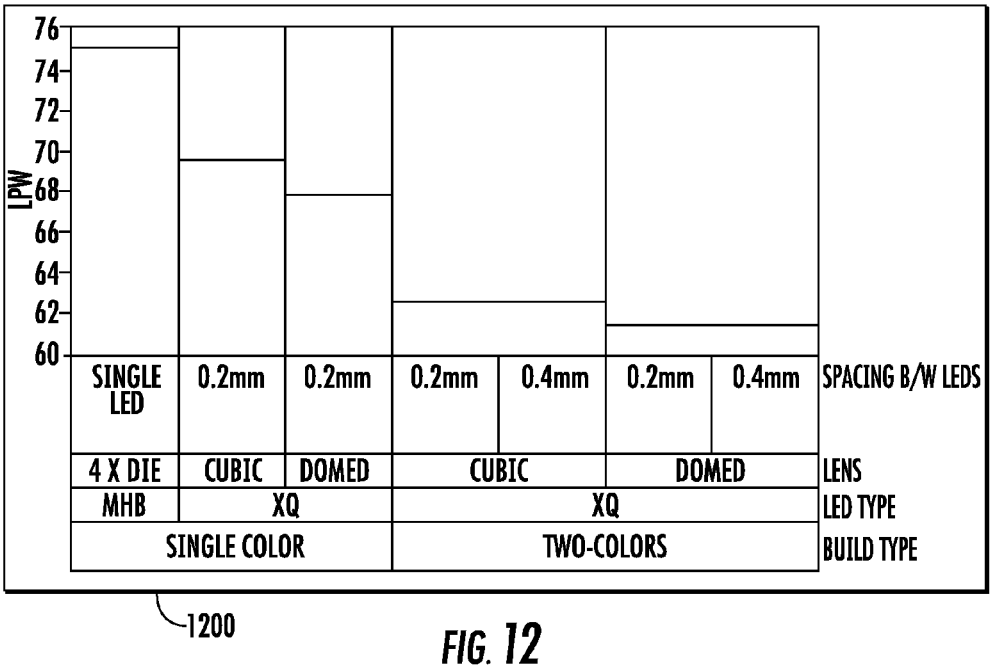
FIG. 12 is a graph showing the efficiency of further configurations of an LED lamp according to example embodiments of the invention.
Figure 13:
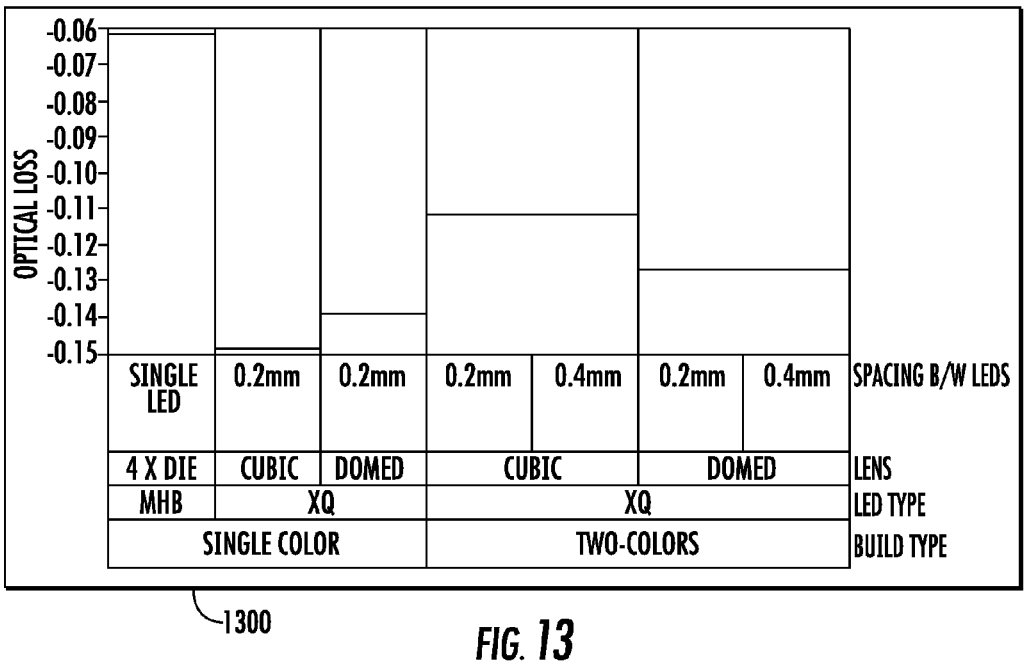
FIG. 13 is a graph showing the optical loss for various configurations of an LED lamp according to example embodiments of the invention.

FIG. 10 is a graph 1000 illustrating the efficiency and an LED candelabra bulb physically like that illustrated in FIGS. 1-3. The spacings for which data are shown refer to alternate spaces between device packages of 0.2 mm and 0.4 mm. The first column shows efficiency in lumens per watt (LPQ) for an MHB series LED with four chips in a single device package and the next column is for a lamp with four XQ series LEDs of a single color. The next columns illustrate efficiencies for devices making use of 2200K and 3200K LEDs together. FIG. 11 shows a color space diagram 1100 for the same configurations illustrated in efficiency graph 1000 of FIG. 10. FIG. 12 is an efficiency graph 1200 much like that shown in FIG. 10, except for the case where the guide optic has been removed so that the lamp is constructed with LEDs on the mounting surface beneath the optical enclosure with no optical tower to further distribute the light. Finally, FIG. 13 shows an optical loss diagram for the same lamp configurations for which efficiency is shown in FIG. 10. The loss shown represents that caused by the guide optic with the optical tower.

A lamp according to any of the above or other embodiments can be assembled by assembling a power supply within the base of the LED lamp, connecting an LED or LEDs to the power supply, connecting an optically transmissive enclosure to the base of the LED lamp to enclose the at least one LED, and installing a distribution optic in or on the base so as to serve as a light pipe by conducting light from the at least one LED for angularly distributed emission from the base of the LED lamp. As part of connecting the LED to the power supply, appropriate supports and circuit boards as previously described can be installed and connected. The various portions of a solid-state lamp or lighting system according to example embodiments of the invention can be made of any of various materials. Heatsinks can be made of metal or plastic, as can the various portions of the housings for the components of a lamp. A system according to embodiments of the invention can be assembled using varied fastening methods and mechanisms for interconnecting the various parts. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, bolts, or other fasteners may be used to fasten together the various components.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

at least one first LED and at least one second LED to provide light of east two different spectral outputs where the at least two spectral outputs comprise a first spectral output with a CCT within a range from about 1200K to about 2200K and a second spectral output with a CCT within a range from about 2700K to about 3500K, the at least one first LED and the at least one second LED disposed on a mounting surface within a 7 mm footprint; and a guide optic disposed to receive the light from the at least one first LED and the at least one second LED;

wherein at portion of the light travels through the guide optic, and the light is emitted from the lamp with a correlated color temperature (CCT) of from 1200K to 3500K that is reduced when the lamp is dimmed.

2. The lamp of claim 1 wherein the at least one first LED and the at least one second LED comprises a plurality of LED chips disposed in a plurality of individual LED device packages.

3. The lamp of claim 2, further comp rising a reflective material between and/or around the plurality of LED chips.

4. The lamp of claim 3 wherein the reflective material comprises at one of a solder mask and a structural component the LED device packages.

5. The lamp of claim 3 wherein the reflective material comprises a reflective dam.

6. The lamp of claim 2 wherein the plurality of LED device packages further comprises two differently shaped lenses.

7. The lamp of claim 6 wherein the two differently shaped lenses comprise a domed lens and a cubic lens.

8. The lamp of claim 7 wherein the plurality of LED device packages further comprises two LED device packages with the domed lens and two LED device packages with the cubic lens.

9. The lamp of claim 1 wherein the at least one first LED and the at least one second LED each comprises a plurality of LED chips disposed in a single LED device package.

10. The lamp of claim 1 wherein the LED and the at least one second LED are disposed on the mounting surface within a 4 mm footprint.

11. A lamp comprising:

a first LED and a second LED to provide light of at least two different spectral outputs where the at least two spectral outputs comprise a first spectral output with a CCT within a range from about 1200K to about 2200K and a second spectral output with a CCT within a range from about 2700K to about 3500K, the first LED and the second LED disposed on a mounting surface; and an optic disposed to receive the light from the first LED and the second LED and comprising a stem where the stem is narrower than the mounting surface.

12. The lamp of claim 11 wherein at least a portion of the light travels through the stem and the light is emitted from the lamp with a correlated color temperature of from 1200 K to 3500 K that is reduced when the lamp is dimmed.

13. The lamp of claim 11 wherein the first LED and the second LED comprises LEDs with differently shaped lenses.

14. The lamp of claim 13 wherein the two differently shaped lenses comprise a domed lens and a cubic lens.

15. The lamp of claim 14, further comprising a reflective material between and/or around the first LED and the second LED.

16. A lamp comprising:

a first LED and a second LED to provide light of different spectral outputs, the first LED comprising a first primary optic and producing light with a first far field pattern and the second LED comprises a second primary optic and producing light with a second far field pattern that is different from the first far field pattern where the first far field pattern comprises light emitted over an angle from about 115 degrees to about 120 degrees and the second far field pattern comprises light emitted over an angle from about 135 degrees to about 140 degrees; and a secondary optic disposed to receive the light from the first LED and the second LED.

17. The lamp of claim 16 wherein the first far field pattern is narrower than the second far field pattern.

18. The lamp of claim 16 wherein the different spectral outputs comprise a first spectral output with a CCT from about 1200K to about 2700K and a second spectral output with a CCT from about 2200K to about 5000K.

19. The lamp of claim 18 further comprising a reflective material en and/or around the first LED and the second LED.

20. A method of assembling a candelabra lamp, the method comprising:

assembling a power supply within or conforming to a base of the candelabra lamp;

connecting at least one first LED and at least one second LED to the power supply wherein the at least one first LED and the at least one second LED are operable to provide light of at least two different spectral outputs, where the at least two spectral outputs comprise a first spectral output with a CCT within a range from about 1200K to about 2200K and a second spectral output with a CCT within a range from about 2700K to about 3500K, and the power supply is operable to selectively dim at least the spectral outputs when the candelabra lamp is dimmed;

installing a guide optic to receive at least some of the light from the at least one first LED and the at least one second LED; and connecting an optically transmissive enclosure to the base of the candelabra lamp to enclose the at least one LED and the guide optic so that the light is emitted from the lamp with a correlated color temperature of from 1200K to 3500K that is reduced when the candelabra lamp is dimmed.

* * * * *